US007017901B2

(12) United States Patent
Shiraishi et al.

(10) Patent No.: US 7,017,901 B2
(45) Date of Patent: Mar. 28, 2006

(54) PAPER TREATING UNIT AND IMAGE FORMING SYSTEM USING THE SAME

(75) Inventors: Tatsuya Shiraishi, Ibaraki (JP); Yasushi Hashimoto, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 119 days.

(21) Appl. No.: 10/634,778

(22) Filed: Aug. 6, 2003

(65) Prior Publication Data

US 2004/0026846 A1 Feb. 12, 2004

(30) Foreign Application Priority Data

Aug. 7, 2002 (JP) ..... P.2002-230544

(51) Int. Cl.
*B65H 31/26* (2006.01)

(52) U.S. Cl. ..... 271/220; 271/221

(58) Field of Classification Search ..... 271/214, 271/215, 217, 220, 221; 414/788.9, 789.1
See application file for complete search history.

(56) References Cited

U.S. PATENT DOCUMENTS 446,447 A * 2/1891 Hart ..... 271/221
584,633 A * 6/1897 Gottlieb ..... 271/221
1,303,040 A * 5/1919 Droitcour ..... 271/221
1,421,868 A * 7/1922 Volkmere ..... 271/221
3,733,070 A * 5/1973 Obenshain ..... 271/221
3,982,751 A * 9/1976 Obenshain ..... 271/221
4,147,342 A * 4/1979 Naramore ..... 271/221
4,346,882 A * 8/1982 Pessina et al. ..... 271/221
5,429,475 A * 7/1995 Mohr ..... 414/788
6,196,540 B1 * 3/2001 Schmid et al. ..... 271/177
6,808,329 B1 * 10/2004 Shiraishi et al. ..... 400/718

FOREIGN PATENT DOCUMENTS

JP 11-138966 5/1999

* cited by examiner

*Primary Examiner*—David H. Bollinger
(74) *Attorney, Agent, or Firm*—McGinn IP Law Group, PLLC

(57) ABSTRACT

A paper treating unit includes: a paper loading table for loading paper; a first paper aligning member that regulates position of the paper by sliding back and forth in the paper proceeding direction; a second paper aligning member disposed upstream of the first paper aligning member in the paper proceeding direction to regulate the position of the paper in the paper proceeding direction; a third paper aligning member disposed along the paper proceeding direction to regulate the position of the paper in a width direction perpendicular to the paper proceeding direction by sliding back and forth in the direction perpendicular to the paper proceeding direction; and a position detecting unit that detects the position of the first to third paper aligning members. The first and third paper aligning members are disposed independently of the paper loading table.

14 Claims, 6 Drawing Sheets

PAPER TREATING UNIT AND IMAGE FORMING SYSTEM USING THE SAME

BACKGROUND OF THE INVENTION

1. Field of the Invention

The present invention relates to a paper treating unit such as a paper exhausting unit connected at the latter stage of an image forming apparatus such as a copier or a laser beam printer.

2. Background Art

The paper exhausting unit is provided at the latter stage of the image forming apparatus to enable the printed paper from the image forming apparatus to be loaded in order. This paper exhausting unit is required to align the paper in order in a paper proceeding direction and a perpendicular direction (paper width direction) to the paper proceeding direction in consideration of the post-processing such as bookbinding.

In JP-A-11-138966, there was disclosed a paper receiving unit for aligning the printed paper. This paper receiving unit comprises a pair of width guide plates arranged in parallel to the paper proceeding direction on a paper receiving tray, and a stop guide plate against which the front edge of the paper abuts. The width guide plates and the stop guide plate can be slid back and forth in the paper width direction and the paper proceeding direction, respectively. Each guide plate is moved from an open position to a closed position to align the paper on the paper receiving tray at a predetermined position, every time one paper is placed on the paper receiving tray. Each guide plate presses the paper to the predetermined position and then returns to the open position.

SUMMARY OF THE INVENTION

According to the above publication, each guide plate is stood on the paper receiving tray, and slidably supported by the paper receiving tray. Accordingly, when the paper is stacked wavelike for some reason, each guide plate presses a number of papers loaded on the paper receiving tray by one operation for aligning the position of one paper. This operation applies a large load on each guide plate and a driving member for driving each guide plate, possibly causing a failure.

The present invention has been achieved in the light of the above-mentioned problems, and it is an object of the invention to provide a paper exhausting unit in which the paper of any size can be loaded reliably and aligned excellently.

To achieve the object, the invention provides paper treating unit including; a paper exhausting roller that delivers the paper passed from a paper exhausting unit in a paper proceeding direction; a paper loading table for loading the paper at a paper loading position; a first paper aligning member that regulates the position of the paper in the paper proceeding direction by sliding back and forth in the paper proceeding direction; a second paper aligning member disposed upstream of the first paper aligning member in the paper proceeding direction to regulate the position of the paper in the paper proceeding direction; a third paper aligning member disposed along the paper proceeding direction to regulate the position of the paper in a width direction perpendicular to the paper proceeding direction by sliding back and forth in the direction perpendicular to the paper proceeding direction; and a position detecting unit that detects the position of the first paper aligning member, the second paper aligning member and the third paper aligning member. Te first paper aligning member and the third paper aligning member are disposed independently of the paper loading table.

In the above paper treating unit, since the first paper aligning member and the third paper aligning member are disposed independently of the paper loading table, the paper can be loaded and aligned excellently without being affected by the paper on the paper loading table.

Preferably, first paper aligning member and the third paper aligning member are disposed above the paper loading table. Accordingly, the paper can be loaded and aligned excellently without being affected by the paper on the paper loading table.

Preferably, the paper treating unit further includes: an upper face detecting unit that detects the uppermost position of the paper loaded on the paper loading table; and a table driving mechanism that moves up or down the paper loading table depending on the uppermost position of the paper detected by the upper face detecting unit.

Since the paper loading table is moved up or down depending on the uppermost position of the paper, the paper can be loaded and aligned excellently, even when a number of sheets of paper are loaded on the paper loading table.

Preferably, the third paper aligning member includes a pair of third paper aligning members separated from each other in the perpendicular direction to the paper proceeding direction to regulate the position of the paper in the perpendicular direction.

Accordingly, the paper can be loaded and aligned excellently by the pair of second paper aligning members.

Preferably, the paper treating unit further includes: a first driving mechanism that drives the first paper aligning member; and a second driving mechanism that drives the third paper aligning member independently of the first driving mechanism.

Since the first paper aligning member and the third paper aligning member are driven independently, each aligning member can be driven in accordance with the paper direction.

Preferably, the first paper aligning member and the third paper aligning member are slid once back and forth every time the paper is exhausted from the paper exhausting unit.

Accordingly, the paper can be loaded and aligned excellently at every time of exhausting the paper.

Preferably, the paper exhausting roller delivers the paper in the paper proceeding direction while delivering the paper in the perpendicular direction; and one of the pair of third paper aligning members is stopped and the other is slid back and forth in the perpendicular direction.

Accordingly, the paper can be delivered obliquely forward, and loaded and aligned excellently, whereby the paper can be distributed to the fore or rear side.

Preferably, the first paper aligning member is slid back and forth between a first standby position apart by a predetermined distance in the paper proceeding direction from the paper loading position and a position around an end of the paper loading position, immediately after the paper is loaded on the paper loading table. By this sliding movement, the paper can be appropriately loaded at the paper loading position.

Preferably, the first paper aligning member is slid back and forth by a distance of 3 mm or less from the first standby position.

Accordingly, the paper is prevented from being jutted out or stacked wavelike, whereby the paper can be loaded and aligned excellently.

Preferably, the third paper aligning member is slid back and forth between a second standby position apart by a predetermined distance in the perpendicular direction from the paper loading position and a position around an end of the paper loading position, immediately after the paper is loaded on the paper loading table.

Accordingly, the paper can be loaded and aligned excellently.

Preferably, the paper treating unit further includes an upper unit disposed above the paper loading table. The upper unit is provided with the first paper aligning member, the third paper aligning member, the first driving mechanism and the second driving mechanism.

Accordingly, the first paper aligning member, the third paper aligning member, the first driving mechanism and the second driving mechanism can be suitably fixed.

Preferably, the paper treating unit is provided for an image forming apparatus; and the paper treating unit is disposed adjacent to the image forming apparatus.

Accordingly, the paper exhausted from the image forming apparatus can be loaded and aligned excellently.

The invention may provides an image forming apparatus system, including an image forming apparatus that forms an image on a paper and the paper treating unit. Accordingly, the paper exhausted from the image forming apparatus can be loaded and aligned excellently.

BRIEF DESCRIPTION OF THE DRAWINGS

The present invention may be more readily described with reference to the accompanying drawings.

DETAILED DESCRIPTION OF THE PREFERRED EMBODIMENTS

The preferred embodiments of the present invention will be described below in detail with reference to the accompanying drawings.

Figure 1:
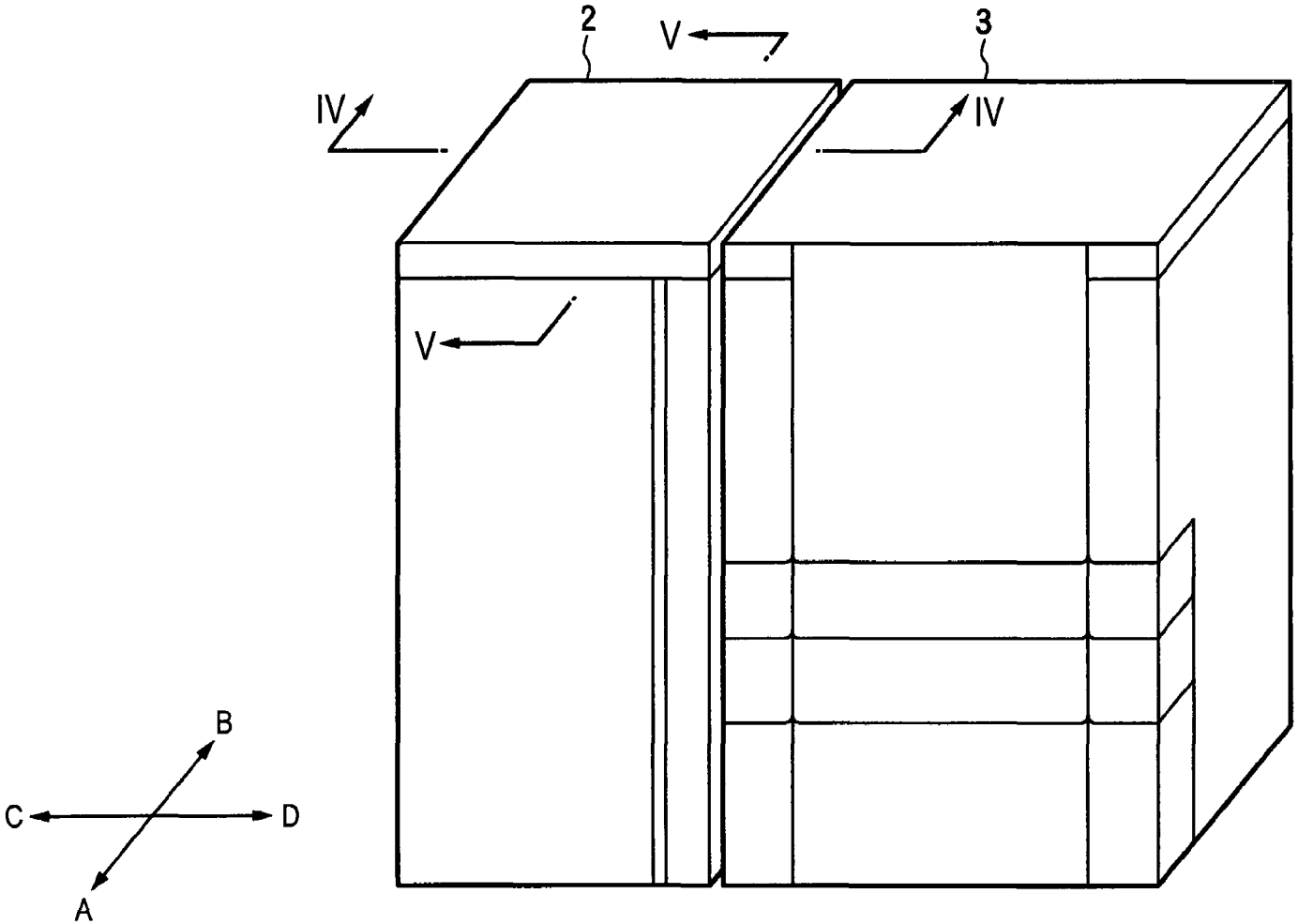
FIG. 1 is a view showing a printing system according to an embodiment of the present invention.

FIG. 1 is a view showing a printing system according to an embodiment of the present invention. A printer 3 as an image forming apparatus and a paper exhausting unit 2 disposed adjacent to the printer 3 are illustrated in FIG. 1. In the following description, an operator side is defined as the fore side of FIG. 1 (Arrow A at FIG. 1), a counter operator side as the rear side (Arrow B at FIG. 1), a paper proceeding direction as the left direction (Arrow C at FIG. 1), and a counter paper proceeding direction as the right direction (Arrow D at FIG. 1).

The printer 3 is the image forming apparatus for forming a predetermined image on the paper, using the toner. The printer 3 delivers the printed paper via an exhausting port, not shown, to a paper exhausting unit 2. A paper exhausting sensor, not shown, is attached near the exhausting port of the printer 3. The paper exhausting sensor senses the paper exhausted to the paper exhausting unit 2 to provide a notification to a control device as will be described later.

The paper exhausting unit 2 receives the paper printed by the printer 3, and loads it inside. The paper exhausting unit 2 comprises a paper loading table 5 for loading the paper, a paper aligning unit 4 for aligning the paper in order on the paper loading table 5, a pair of paper conveying rollers 9*a* and 9*b* for conveying the paper received from the printer 3 to the operator side or counter operator side on the paper loading table 5, and a paper trailing edge stopper 45 for defining the position of the trailing edge of the paper 1 in the counter paper proceeding direction. Also, the paper exhausting unit 2 has the control unit 100 for generally controlling the operation of each unit in accordance with a print situation of the printer 3. The control unit 100 may be provided on the printer 3 to control the paper exhausting unit 2 and the printer 3 at the same time.

Figure 2:
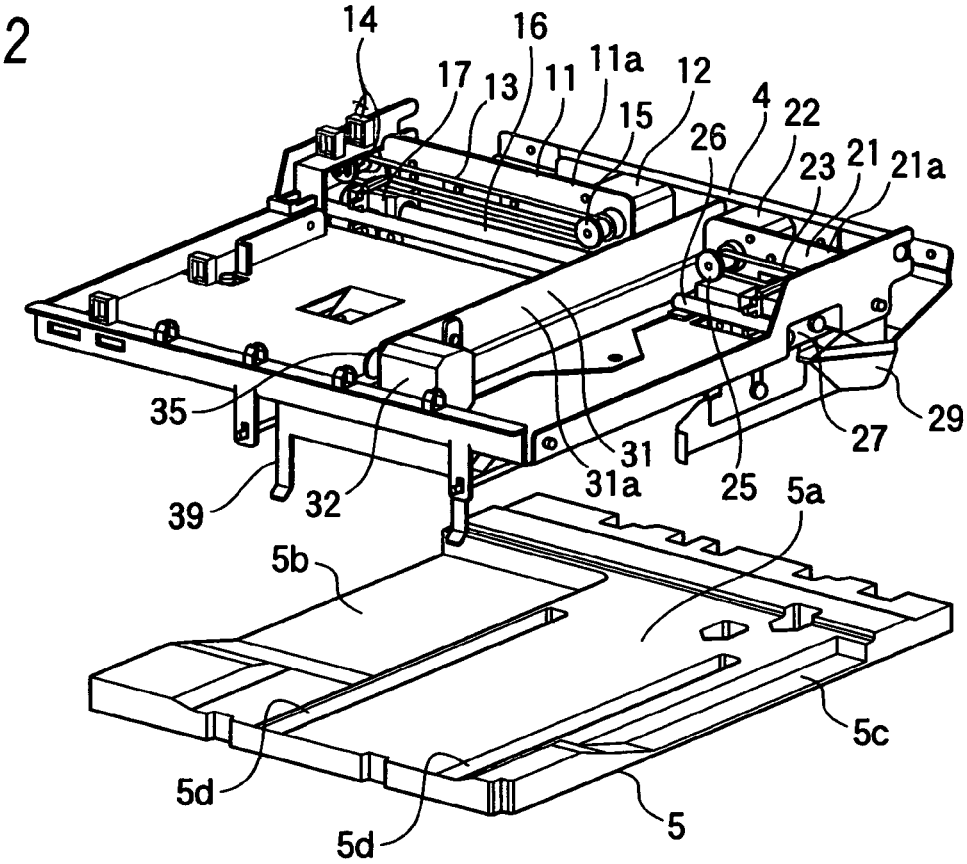
FIG. 2 is a perspective view showing a paper aligning unit and a paper loading table.
Figure 3:
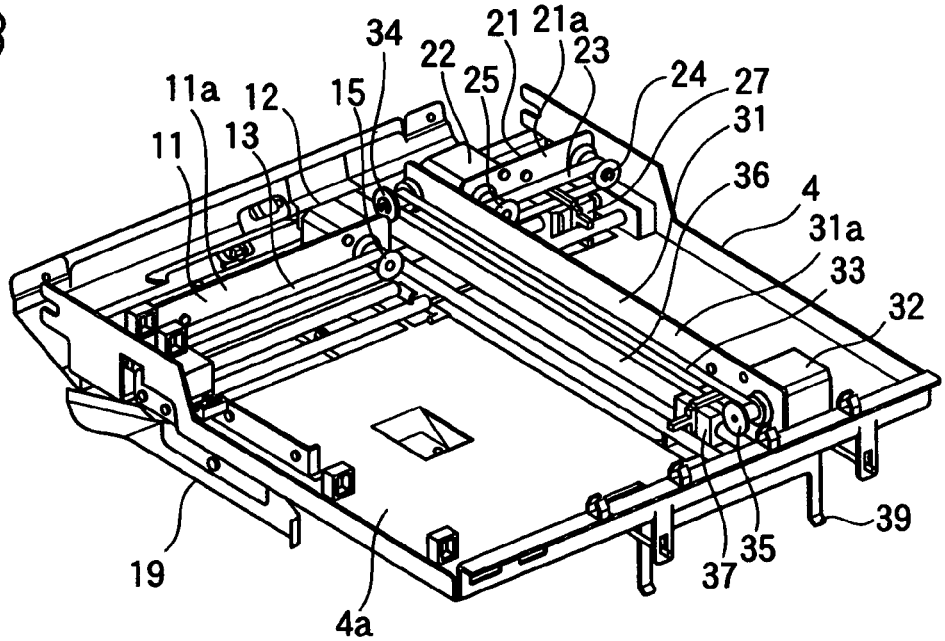
FIG. 3 is a perspective view showing the paper aligning unit as seen from a different angle from FIG. 2.

FIG. 2 is a perspective view showing the paper aligning unit 4 and the paper loading table 5. FIG. 3 is a perspective view showing the paper aligning unit 4 as seen from a different angle from FIG. 2.

Figure 4:
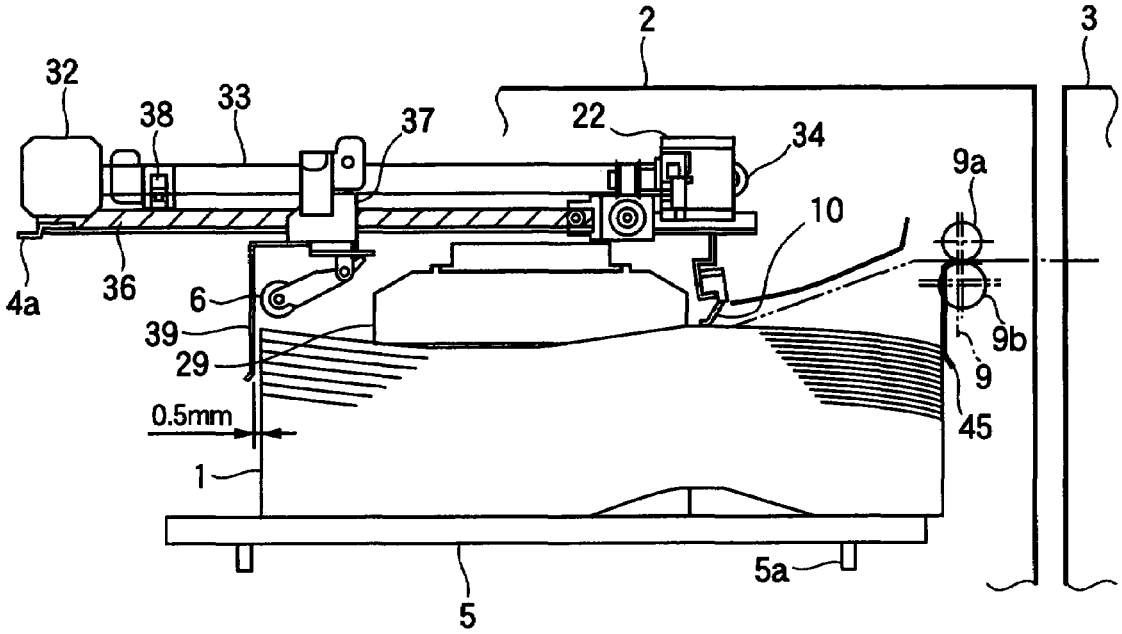
FIG. 4 is a schematic cross-sectional view taken along the line IV—IV in FIG. 1.
Figure 5:
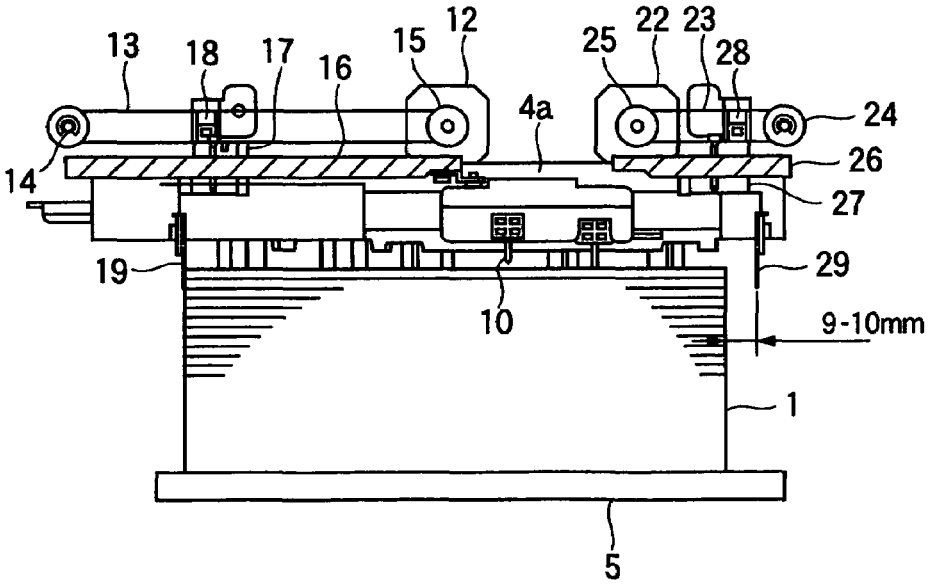
FIG. 5 is a schematic cross-sectional view taken along the line V—V in FIG. 1.
Figure 6:
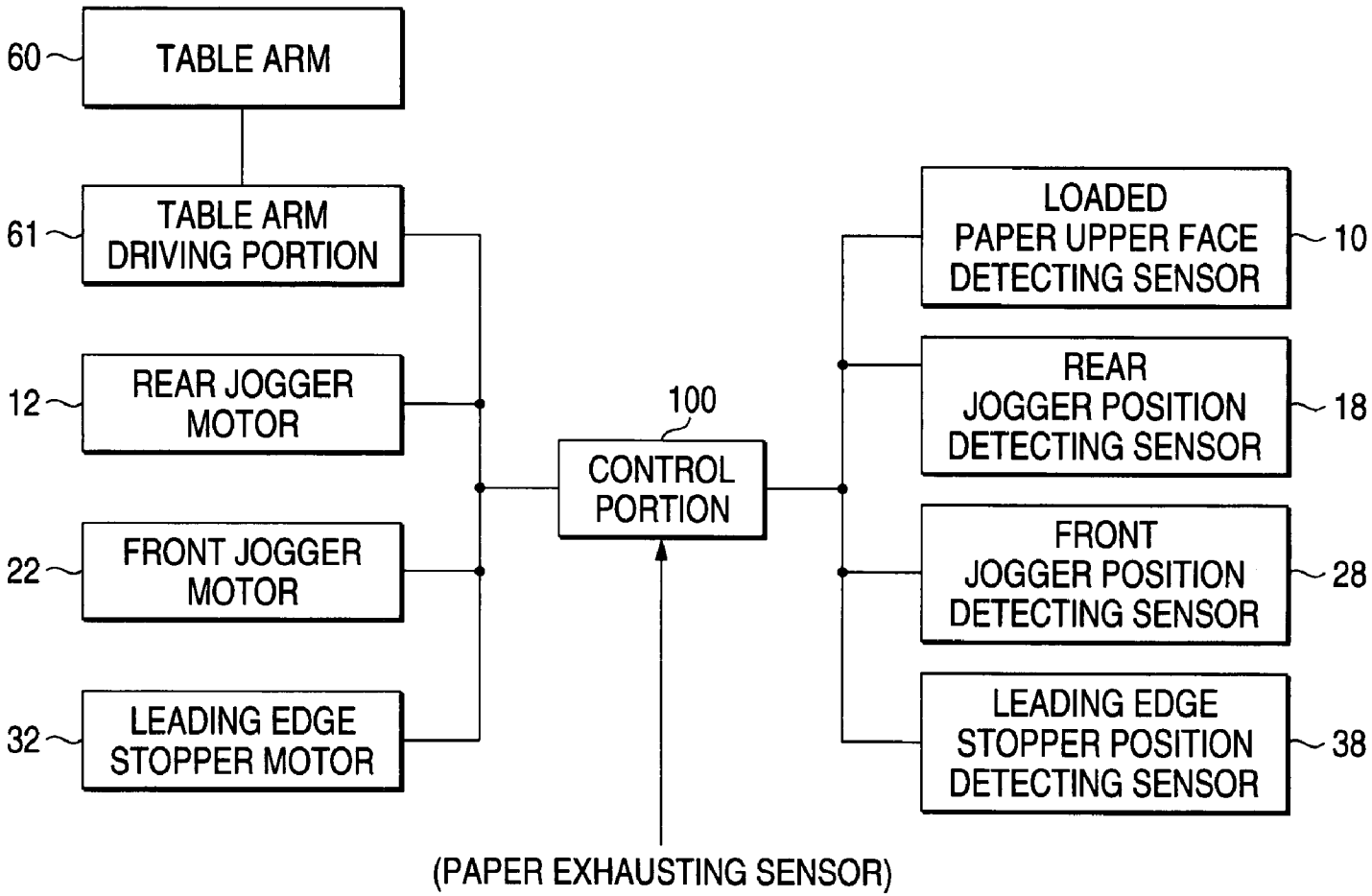
FIG. 6 is a block diagram for explaining the control relation of a paper exhausting unit.

The paper aligning unit 4 is fixed on an upper portion inside a housing of the paper exhausting unit 2. The paper loading table 5 is located beneath the paper aligning unit 4, and movable up and down inside the housing of the paper exhausting unit 2. The paper loading table 5 is moved vertically depending on the amount of paper loaded on the paper loading table 5. FIG. 4 is a schematic cross-sectional view taken along the line IV—IV in FIG. 1. FIG. 5 is a schematic cross-sectional view taken along the line V—V in FIG. 1. FIG. 6 is a block diagram for explaining the control relation of the paper exhausting unit 2. FIGS. 4 and 5 only illustrate the main parts, and the unnecessary parts for explanation are appropriately omitted.

First of all, the paper exhausting unit 4 will be described below. The paper aligning unit 4 has a plate-like main portion 4*a* as a base substance. On an upper face of the main portion 4*a*, a rear jogger driving portion 11, a front jogger driving portion 21 and a leading edge stopper driving portion 31 are disposed. On a lower face of the main portion 4*a*, a paper upper face pressing roller 6, and a loaded paper upper face detecting sensor 10 are placed. The loaded paper upper face detecting sensor 10 detects the distance from the loaded paper upper face detecting sensor 10 to the upper face of the paper loaded on the paper loading table 5. The loaded paper upper face detecting sensor 10 sends the detected distance data to the control unit 100.

Beneath the main portion 4*a*, a rear jogger 19 connected to the rear jogger driving portion 11, a front jogger 29 connected to the front jogger driving portion 21, and a leading edge stopper 39 connected to the leading edge stopper driving portion 31 are disposed.

The rear jogger driving portion 11 is a member for driving the rear jogger 19, and installed from the counter operator side to the central part of the main portion 4*a*. The rear jogger driving portion 11 has a plate 11*a*, a rear jogger motor 12, a driving belt 13, a follower pulley 14, a driving pulley 15, a guide shaft 16, a rear jogger fixing portion 17 and a rear jogger position detecting sensor 18.

The plate 11*a* has an almost rectangular shape, and is fixed on the main portion 4*a* in such a manner that it is stood in a width direction and extended in a longitudinal direction from the counter operator side to the almost central part of the main portion 4*a* in a direction (i.e., a paper width direction) orthogonal to the paper proceeding direction. The rear jogger motor 12 and the driving pulley 15 are fi15xed with each other via the plate 11*a* near an end portion of the plate 11*a* on the central side. Also, the follower pulley 14 is fixed on the same plane as an arranged plane of the driving pulley 15 near an end portion of the plate 11*a* on the counter operator side.

A main shaft of the rear jogger motor 12 is connected to the driving pulley 15. The rear jogger motor 12 rotates the driving pulley 15 by driving the main shaft in accordance with an instruction of the control unit 100. The driving belt 13 is looped between the driving pulley 15 and the follower pulley 14. The driving belt 13 is driven along with the rotation of the driving pulley 15.

The rear jogger fixing portion 17 has a through hole in the central part. The guide shaft 16 is inserted into the through hole of the rear jogger fixing portion 17 to support the rear jogger fixing portion 17 slidably. The rear jogger fixing portion 17 is fixed to the driving belt 13 and moved along the guide shaft 16 in the paper width direction when the driving belt 13 is driven.

The rear jogger 19 is always located above the paper loading table 5, and moved back and forth in the paper width direction as the rear jogger fixing portion 17 is slid. The rear jogger 19 is controlled with its position by the control unit 100 to regulate the position of paper in the paper width direction and position the paper on the paper loading table 5.

The rear jogger position detecting sensor 18 reads the information regarding the position of the rear jogger 19 from a position detection mark such as a slit cut on the driving belt 13. The rear jogger position detecting sensor 18 sends the information of the read position detection mark to the control unit 100. The control unit 100 controls the position of the rear jogger 19 on the basis of the read information.

The front jogger driving portion 21 is a member for driving the front jogger 29, and installed from the operator side to the fore central part of the main portion 4*a*. The front jogger driving portion 21 and the rear jogger driving portion 11 are disposed on the almost same line in the paper width direction. The front jogger driving portion 21 has a plate 21*a*, a front jogger motor 22, a belt 23, a follower pulley 24, a driving pulley 25, a guide shaft 26, a front jogger fixing portion 27 and a front jogger position detecting sensor 28.

The plate 21*a* has an almost rectangular shape, and is fixed on the main portion 4*a* in such a manner that it is extended in its longitudinal direction from the operator side to the fore central part of the main portion 4*a* in the paper width direction. The plate 21*a* is disposed on the same line as the plate 11*a* for the front jogger driving portion 11. The plate 21*a* is shorter in the width direction than the plate 11*a*. The front jogger motor 22 and the driving pulley 25 are fixed with each other via the plate 21*a* near an end portion of the plate 21*a* on the central side. Also, the follower pulley 24 is fixed on the same plane as an arranged plane of the driving pulley 25 near an end portion of the plate 21*a* on the counter operator side.

A main shaft of the rear jogger motor 22 is connected to the driving pulley 25. The rear jogger motor 22 rotates the driving pulley 25 by driving the main shaft in accordance with an instruction of the control unit 100. The driving belt 23 is looped between the driving pulley 25 and the follower pulley 24. The driving belt 23 is driven along with the rotation of the driving pulley 25.

The front jogger fixing portion 27 has a through hole in the central part. The guide shaft 26 is inserted into the through hole of the front jogger fixing portion 27 to support the front jogger fixing portion 27 movably. The front jogger fixing portion 27 is fixed to the driving belt 23 and moved along the guide shaft 26 in the paper width direction when the driving belt 23 is moved.

The front jogger 29 is always located above the paper loading table 5, and substantially opposed to the rear jogger 19 in the width direction. The front jogger 29 is reciprocated in the paper width direction along with the movement of the front jogger fixing portion 27. The front jogger 29 has its position decided by the control unit 100 to position the paper on the paper loading table 5 by regulating the position in a direction perpendicular to the paper proceeding direction.

The front jogger position detecting sensor 28 reads the information regarding the position of the front jogger 29 from a position detection mark such as a slit cut on the driving belt 23. The front jogger position detecting sensor 28 sends the information of the read position detection mark to the control unit 100. The control unit controls the position of the rear jogger 29 on the basis of the read information.

The leading edge stopper driving portion 31 is a member for driving the leading edge stopper 39, and is disposed along the paper proceeding direction between the rear jogger driving portion 19 and the front jogger driving portion 29. The leading edge stopper driving portion 31 comprises a plate 31*a*, a leading edge stopper motor 32, a driving belt 33, a follower pulley 34, a driving pulley 35, a guide shaft 36, a leading edge stopper fixing portion 37, and a leading edge stopper position detecting sensor 38.

The plate 31*a* has an almost rectangular shape, and is fixed on the main portion 4*a* in such a manner that it is stood in a width direction and extended in a longitudinal direction to be parallel to the paper proceeding direction. The leading edge stopper motor 32 and the driving pulley 35 are fixed with each other via the plate 31*a* near an end portion of the plate 31*a* in the paper proceeding direction. Also, the follower pulley 34 is fixed on the same plane as an arranged plane of the driving pulley 35 near an end portion of the plate 31*a* in the counter paper proceeding direction.

A main shaft of the leading edge stopper motor 32 is connected to the driving pulley 35. The leading edge stopper motor 32 rotates the driving pulley 35 by driving the main shaft in accordance with an instruction of the control unit 100. The driving belt 33 is looped between the driving pulley 35 and the follower pulley 34. The driving belt 33 is driven along with the rotation of the driving pulley 35.

The leading edge stopper fixing portion 37 has a through hole in the central part. The guide shaft 36 is inserted into the through hole of the leading edge stopper fixing portion 37 to support the leading edge stopper fixing portion 37 movably. The leading edge stopper fixing portion 37 is fixed to the driving belt 33 and moved back and forth along the guide shaft 36 in the paper width direction when the driving belt 13 is driven.

The leading edge stopper 39 is always located above the paper loading table 5, and substantially opposed to the trailing edge stopper 45 in the paper proceeding direction. The leading edge stopper 39 is moved back and forth along the paper proceeding direction along with the movement of the leading edge stopper fixing portion 37, every time one sheet of paper 1 is exhausted on the paper loading table 5. The leading edge stopper 39 has its position decided by the control unit 100 to position the paper on the paper loading table 5 by regulating the position in the paper width direction. Specifically, the leading edge stopper 39 is on standby at a position of plus 0.5 mm in the paper proceeding direction, and reciprocated from the position of plus 0.5 mm in the paper proceeding direction to the position of the leading edge of paper. The distance between the standby position of the leading edge stopper 39 and the paper leading edge position is not limited to this, but may be within 3 mm, and preferably about 0.5 mm.

The leading edge stopper detecting sensor 36 reads the information regarding the position from a position detection mark such as a slit or projection on the driving belt 33. The leading edge stopper position detecting sensor 38 sends the information of the read position detection mark to the control unit 100. The control unit 100 controls the position of the leading edge stopper 39 on the basis of the read information The paper loading table 5 will be now described. The paper loading table 5 is an almost rectangular plate, and supported by a table arm 60. The table arm 60 is driven vertically by a table arm driving portion 61, and the paper loading table 5 is moved vertically along with the movement of the table arm 60.

The paper loading table 5 has a paper loading face 5*a* for loading the paper of arbitrary shape on an upper plane. On the paper loading table 5*a*, a rear jogger clearance groove 5*b*, a front jogger clearance groove 5*c*, and a leading edge stopper clearance groove 5*d* are formed in the movement direction of the rear jogger 19, the front jogger 29 and the leading edge stopper 39, respectively. The clearance grooves 5*b* to 5*d* allow the top end of the lower portion of the rear jogger 19, the front jogger 29 and the leading edge stopper 39 to be located under the paper loaded on the lowermost face, when the paper loading table 5 comes in most vicinity to the paper aligning unit 4. Also, a paper trailing edge projection 16 for preventing the paper 1 from being swung wide is formed on the paper loading face 5*a*.

Figure 7:
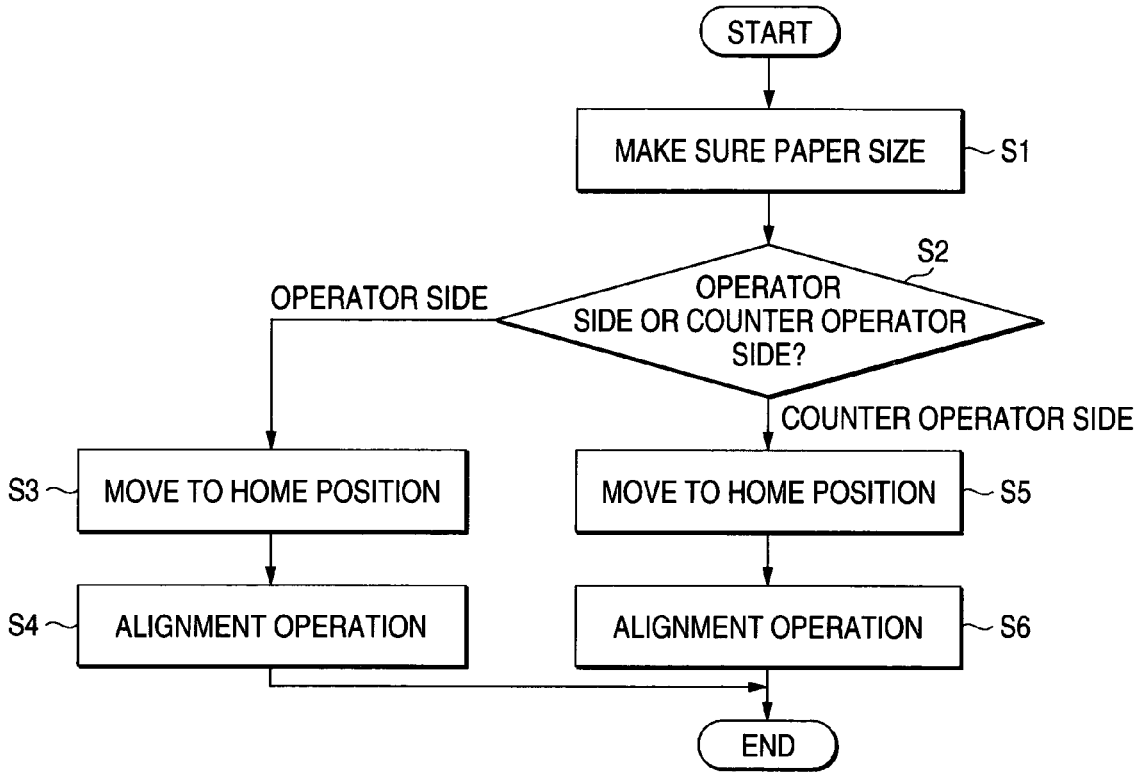
FIG. 7 is a flowchart for explaining the operation of the paper exhausting unit.

Referring to FIG. 7, the operation of a paper exhausting unit 2 will be described below.

FIG. 7 is a flowchart for explaining the operation of the paper exhausting unit 2. If the image forming apparatus 3 starts printing, the control unit 100 receives the information regarding the size of paper used in printing and the paper direction from the image forming apparatus 3, and confirms the size and direction of the paper (step S1).

The control unit 100 receives the information regarding the direction of distributing the paper (job shift direction) from the image forming apparatus 3, and determines whether to distribute the paper to the operator side or counter operator side (step S2).

The operation for distributing (job shifting) the paper to the operator side will be described below. The control unit 100 moves the rear jogger 19, the front jogger 29 and the leading edge stopper 39 to their specified home positions in accordance with the size and direction of the paper and the job shift direction (step S3).

Specifically, the rear jogger 19 is moved near the paper position on the operator side where the paper 1 is loaded to be contact with the edge on the counter operator side, and stopped. On the other hand, the front jogger 29 is on standby at the paper position on the operator side where the paper 1 is loaded, which is located a specified amount away from the edge on the operator side. Herein, the front jogger 19 is preferably on standby at a position 9 to 10 mm away from the edge on the operator side.

The leading edge stopper 39 is moved near the paper position where the paper 1 is loaded to be contact with the edge in the paper proceeding direction, irrespective of the direction for job shifting the paper 1, and placed on standby.

Every time the paper 1 is exhausted from the printer 3 and passed to the paper exhausting unit 2, the pair of paper conveying rollers 9*a* and 9*b* convey the paper 1, inclined to the job shift direction (operator side), on the paper loading table 6. The front jogger 29 and the leading edge stopper 39 push the paper into the paper position toward the rear jogger 19 and the trailing edge stopper 45 that are located at opposite positions on the counter operator side and in the counter paper proceeding direction, and aligns the paper at the paper position where the paper 1 is loaded, every time the paper 1 is stacked via the paper conveying rollers 9*a* and 9*b* on the paper loading table 6 (step S4). Herein, the rear jogger 19 is fixed and not moved during the pushing and aligning operation of the front jogger 18. After the end of pushing the paper, the front jogger 29 and the leading edge stopper 39 return to their home positions.

The operation for distributing (job shifting) the paper to the counter operator side will be now described. The control unit 100 moves the rear jogger 19, the front jogger 29 and the leading edge stopper 39 to their specified home positions in accordance with the size and direction of the paper and the job shift direction (step S5).

Specifically, the front jogger 29 is moved near a paper position on the operator side to load the paper 1, which is contact with the edge on the operator side, and stopped on the other hand, the rear jogger 19 is on standby at the paper position on the counter operator side where the paper 1 is loaded, which is a specified amount away from the edge on the counter operator side. Herein, the rear jogger 19 is preferably on standby at a position 9 to 10 mm away from the edge on the counter operator side.

The leading edge stopper 39 is moved near the paper position where the paper 1 is loaded, which is in contact with the edge on the paper proceeding direction, irrespective of the direction for job shifting the paper 1, and placed on standby.

Every time the paper 1 is exhausted from the printer 3 and sent to the paper exhausting unit 2, the pair of paper conveying rollers 9*a* and 9*b* passes the paper 1, inclined to the job shift direction (counter operator side), onto the paper loading table 6. The rear jogger 19 and the leading edge stopper 39 push the paper into the paper position toward the front jogger 29 and the trailing edge stopper 45 that are located at opposite positions in the operator side and the counter paper proceeding direction, and aligns the paper at the paper position where the paper 1 is loaded, every time the paper 1 is stacked via the paper conveying rollers 9*a* and 9*b* on the paper loading table 6 (step S6). Herein, the front jogger 19 is fixed and not moved during the pushing and aligning operation of the front jogger 18. After the end of pushing the paper, the front jogger 29 and the leading edge stopper 39 return to their home positions.

The table arm driving portion 61 drives the table arm 60 up or down to adjust the height of the paper loading table 5 in accordance with the upper face position of paper on the paper loading table 5 that is detected by the loaded paper upper face detecting sensor 10. That is, the paper loading table 5 is moved down in accordance with an increase in the amount of loading the paper 1, so that the rear jogger 19, the front jogger 29 and the leading edge stopper 39 always aligns the paper 1 on the paper loading table 5 at the same height.

An instance will be described where the job shift direction is changed to the operator side or the counter operator side many times for classification of the paper 1 during the printing in the image forming apparatus 1. In this instance, the control unit 100 moves down the paper loading table 5 to the position at which the stopper 39 does not interfere with the paper 1 already loaded, before the rear and front joggers 19 and 29 are moved in the specified paper width direction. Then, the joggers 19 and 29 are moved to the position corresponding to the specified job shift direction, and the paper loading table 6 is moved up to the position where it is detected by the paper upper face detecting means 10, whereby the paper 1 continues to be loaded on the paper loading table 6. With this method, even when a large amount of sheets of paper 1 are loaded on the paper loading table 6, the sheets of paper can be aligned without applying a load or vibration on the paper 1 already loaded, and without losing the alignment.

In this embodiment, the rear jogger 19, the front jogger 29 and the leading edge stopper 39 are attached above the paper loading table 5. And the rear jogger 19, the front jogger 29 and the leading edge stopper 39 are always located at the same height, whereby the position of the paper 1 is aligned by moving up or down the paper loading table 5. Accordingly, the rear jogger 19, the front jogger 29 and the leading edge stopper 39 can load and align the paper on the uppermost face, so that the new loaded paper 1 can be appropriately loaded and aligned.

Also, in this embodiment, the rear jogger 19 and the front jogger 29 are on standby in the back and forth operation at the position apart by a specified amount of 9 to 10 mm from the edge parallel to the paper proceeding direction, and reciprocated from that position to the relative position contact with the paper edge, whereby the paper 1 is not pushed beyond the paper width. Consequently, the paper 1 can be aligned more excellently without vibrating it.

Figure 8:
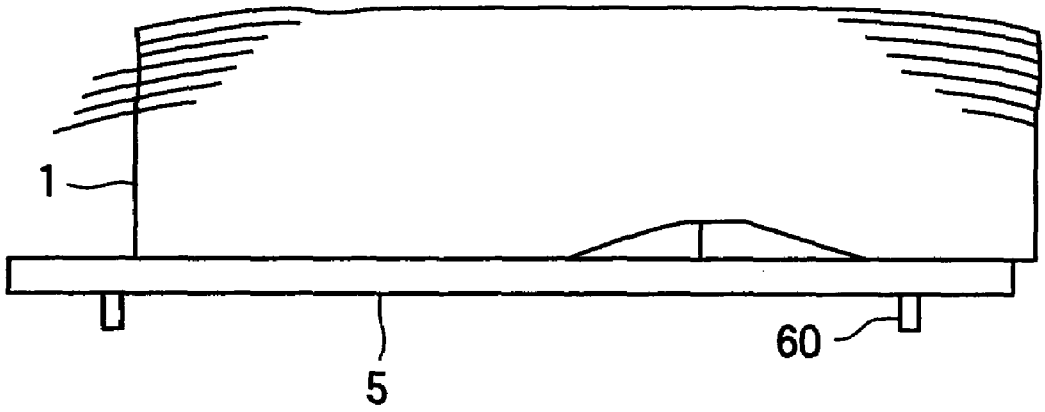
FIG. 8 is a view for explaining a defect of the paper exhausting unit.
Figure 9:
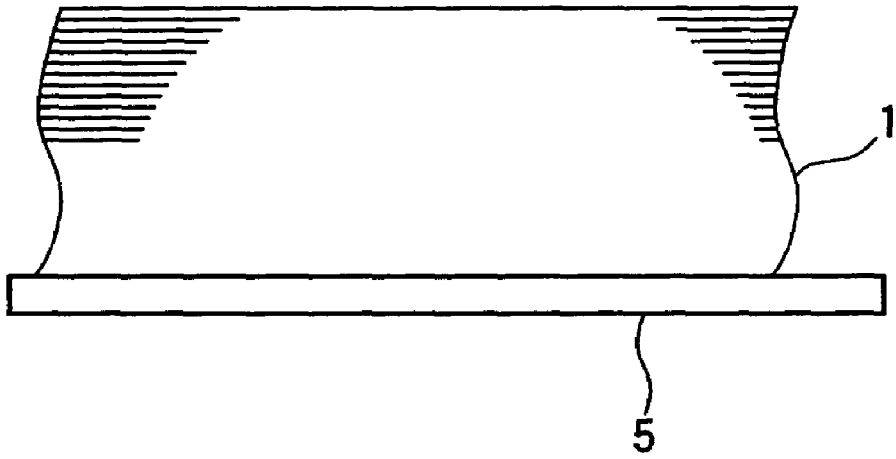
FIG. 9 is a view for explaining another defect of the paper exhausting unit.

In performing the back and forth operation of pushing and aligning the leading edge of paper where the leading edge stopper 39 is on standby at a position apart from the leading edge of paper, when the paper 1 is exhausted with a face having toner image formed turned downward, the paper 1 has a paper curling direction downward, so that the paper may be trapped in an interstice between the leading edge stopper 39 and the paper leading edge. Moreover, when the paper has a larger downward curl, the leading edge stopper 39 may not push the leading edge of paper. In this case, several sheets of paper may be jutted out to make the stack out of alignment, as shown in FIG. 8. Moreover, if the leading edge of paper is pushed in the direction opposite to the paper proceeding direction beyond contact with the leading edge stopper 39, the paper 1 is vibrated, so that the edge of the loaded paper may become wavelike to make the stake out of alignment, as shown in FIG. 9.

However, in this embodiment, the leading edge stopper 39 is on standby at a position of 0.5 mm plus the length in the paper proceeding direction, and moved back and forth from the position of 0.5 mm plus the length In the paper proceeding direction to the paper leading edge position. In this manner, it is possible to prevent the paper from being jutted out or stacked wavelike by the leading edge stopper 39.

It is possible to set up the time lag from the time when the paper 1 is exhausted on the paper loading table 1 to the time when the joggers 19 and 29 and the leading edge stopper 39 are driven appropriately in accordance with the size and kind of paper.

With this invention, it is possible to provide a paper exhausting unit in which the paper of any size can be loaded reliably and aligned excellently.

What is claimed is:

1. A paper treating unit comprising:

a paper exhausting roller that delivers paper passed from a paper exhausting unit in a paper proceeding direction;

a paper loading table that loads the paper at a paper loading position;

a first paper aligning member that regulates the position of the paper in the paper proceeding direction;

a first sliding unit for sliding back and forth said first paper aligning member, said first paper aligning member regulating the position of the paper by sliding back and forth in the paper proceeding direction;

a second paper aligning member disposed upstream of the first paper aligning member in the paper proceeding direction to regulate the position of the paper in the paper proceeding direction;

a third paper aligning member disposed along the paper proceeding direction to regulate the position of the paper in a width direction perpendicular to the paper proceeding direction;

a second sliding unit for sliding back and forth said third paper aligning member, said third paper aligning member regulating the position of the paper by sliding back and forth in the width direction perpendicular to the paper proceeding direction; and a position detecting unit that detects the position of the first paper aligning member, the second paper aligning member and the third paper aligning member, wherein the first paper aligning member and the third paper aligning member are disposed independently of the paper loading table.

2. The paper treating unit according to claim 1, wherein the first paper aligning member and the third paper aligning member are disposed above the paper loading table.

3. The paper treating unit according to claim 1, further comprising:

an upper face detecting unit that detects the uppermost position of the paper loaded on the paper loading table; and a table driving mechanism that moves up or down the paper loading table depending on the uppermost position of the paper detected by the upper face detecting unit.

4. The paper treating unit according to claim 1, further comprising another third paper aligning member separated from the third paper aligning member in the width direction perpendicular to the paper proceeding direction to regulate the position of the paper in the width direction.

5. The paper treating unit according to claim 4, wherein said third paper aligning member and said another third paper aligning member form a pair of third paper aligning members, wherein the paper exhausting roller delivers the paper in the paper proceeding direction while delivering the paper in the width direction; and one of the pair of third paper aligning members is stopped and the other is slid back and forth in the width direction.

6. The paper treating unit according to claim 1, wherein:

said first sliding unit comprises a first driving mechanism that drives the first paper aligning member; and said second sliding unit comprises a second driving mechanism that drives the third paper aligning member independently of the first driving mechanism.

7. The paper treating unit according to claim 6, further comprising:

an upper unit disposed above the paper loading table;

wherein the upper unit is provided with the first paper aligning member, the third paper aligning member, the first driving mechanism and the second driving mechanism.

8. The paper treating unit according to claim 1, wherein the first paper aligning member and the third paper aligning member are slid by the first and second sliding units, respectively, once back and forth every time the paper is exhausted from the paper exhausting unit.

9. The paper treating unit according to claim 1, wherein the first paper aligning member is slid back and forth, by said first sliding unit, between a first standby position separated, by a predetermined distance in the paper proceeding direction, from the paper loading position and a position around an end of the paper loading position, immediately after the paper is loaded on the paper loading table.

10. The paper treating unit according to claim 9, wherein the first paper aligning member is slid back and forth by a distance 3 mm or less from the first standby position.

11. The paper treating unit according to claim 1, wherein the third paper aligning member is slid back and forth, by said second sliding unit, between a second standby position separated, by a predetermined distance in the perpendicular direction, from the paper loading position and a position around an end of the paper loading position, immediately after the paper is loaded on the paper loading table.

12. The paper treating unit according to claim 1, wherein the paper exhausting unit is adapted for use with an image forming apparatus; and the paper treating unit is disposed adjacent to the image forming apparatus.

13. An image forming apparatus system, comprising:

an image forming apparatus that forms an image on paper; and a paper treating unit;

wherein the paper treating unit includes:

a paper exhausting roller that delivers the paper passed from the image forming apparatus in a paper proceeding direction;

a paper loading table for loading the paper at a paper loading position;

a first paper aligning member that regulates the position of the paper in the paper proceeding direction;

a first sliding unit for sliding back and forth said first paper aligning member, said first paper aligning member regulating the position of the paper by sliding back and forth in the paper proceeding direction;

a second paper aligning member disposed upstream of the first paper aligning member in the paper proceeding direction to regulate the position of the paper in the paper proceeding direction;

a third paper aligning member disposed along the paper proceeding direction to regulate the position of the paper in a width direction perpendicular to the paper proceeding direction;

a second sliding unit for sliding back and forth said third paper aligning member, said third paper aligning member regulating the position of the paper by sliding back and forth in the width direction perpendicular to the paper proceeding direction; and a position detecting unit that detects the position of the first paper aligning member, the second paper aligning member and the third paper aligning member; and the first paper aligning member and the third paper aligning member are disposed independently of the paper loading table.

14. A paper treating unit comprising:

a paper exhausting roller that delivers paper passed from a paper exhausting unit in a paper proceeding direction;

a paper loading table that loads the paper at a paper loading position;

first regulating means for regulating the position of the paper in the paper proceeding direction;

first sliding means for sliding back and forth said first regulating means, said first regulating means regulating the position of the paper by sliding back and forth in the paper proceeding direction;

second regulating means, disposed upstream of the first regulating means in the paper proceeding direction, for regulating the position of the paper in the paper proceeding direction;

third regulating means, disposed along the paper proceeding direction, for regulating the position of the paper in a width direction perpendicular to the paper proceeding direction;

second sliding means for sliding back and forth said third regulating means, said third regulating means regulating the position of the paper by sliding back and forth in the width direction perpendicular to the paper proceeding direction; and position detecting means for detecting the position of the first regulating means, the second regulating means and the third regulating means, wherein the first regulating means and the third regulating means are disposed independently of the paper loading table.

* * * * *